US007239841B2

(12) United States Patent
Jeong et al.

(10) Patent No.: US 7,239,841 B2
(45) Date of Patent: Jul. 3, 2007

(54) USED TONER COLLECTING APPARATUS OF A LASER PRINTER

(75) Inventors: Heung-eup Jeong, Suwon-si (KR); Jin-soo Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 161 days.

(21) Appl. No.: 10/830,084

(22) Filed: Apr. 23, 2004

(65) Prior Publication Data

US 2005/0002706 A1 Jan. 6, 2005

(30) Foreign Application Priority Data

Jul. 1, 2003 (KR) ..... 10-2003-0044165

(51) Int. Cl.
*G03G 21/00* (2006.01)

(52) U.S. Cl. ..... 399/358; 399/360

(58) Field of Classification Search ..... 399/120, 399/358–360

See application file for complete search history.

(56) References Cited

U.S. PATENT DOCUMENTS 6,381,443 B1 * 4/2002 Kawata et al. ..... 399/407

FOREIGN PATENT DOCUMENTS

| | | | |
|---|---|---|---|
| JP | 03073986 | A * | 3/1991 |
| JP | 5-224564 | | 9/1993 |
| JP | 09311602 | A * | 12/1997 |
| JP | 11-119619 | | 4/1999 |
| JP | 11119619 | A * | 4/1999 |
| JP | 11-202710 | | 7/1999 |
| JP | 11-272138 | | 10/1999 |
| JP | 11-327393 | | 11/1999 |
| JP | 2001042730 | A * | 2/2001 |
| JP | 2002229403 | A * | 8/2002 |
| KR | 1999-001282 | | 1/1999 |
| KR | 1999-6072 | | 2/1999 |

OTHER PUBLICATIONS

"Flexible Auger Toner Transport"; IBM Technical Disclosure Bulletin; vol. 15; No. 4; p. 1262; 9-1972.*

* cited by examiner

*Primary Examiner*—David M. Gray
*Assistant Examiner*—Ryan Gleitz
(74) *Attorney, Agent, or Firm*—Staas & Halsey LLP

(57) ABSTRACT

A used toner collecting apparatus of a laser printer includes a collecting container disposed at the body of the laser printer and having a used toner inlet through which the used toner transferred from the cleaner comes. A shattering member is disposed inside the collecting container and having a breaking blade to break the used toner that comes and drops through the used toner inlet.

29 Claims, 9 Drawing Sheets

USED TONER COLLECTING APPARATUS OF A LASER PRINTER

CROSS-REFERENCE TO RELATED APPLICATIONS

This application claims the benefit under 35 U.S.C. §119 (a) of Korean Patent Application No. 2003-44105 filed Jul. 1, 2003, in the Korean Intellectual Property Office, the disclosure of which is incorporated herein by reference.

BACKGROUND OF THE INVENTION

1. Field of the Invention

The present invention relates to a used toner collecting apparatus of a laser printer.

2. Description of the Related Art

FIG. 1 shows a conventional laser printer. Referring to FIG. 1, the laser printer includes a corona unit 2, a charging unit 3, a laser scanning unit 4, developing units 5*a*, 5*b*, 5*c*, 5*d* to developing colors in the order of black K, yellow Y, magenta M, and cyan C, and a transferring belt 6. The respective parts are disposed along a rotating direction of a photosensitive drum 1 which is employed as a photosensitive medium.

A surface of the photosensitive drum 1 is evenly initialized to a predetermined voltage by the corona unit 2. The charging unit 3 charges the initialized surface of the photosensitive drum 1 to a predetermined electric potential. The laser-scanning unit 4 scans a laser beam selectively on the charged surface of the photosensitive drum 1 and forms an electrostatic latent image thereon in accordance with a desired image. The electrostatic latent image is developed to a desired color image as the developers 5*a*, 5*b*, 5*c*, 5*d* are overlain on one another. The color image on the surface of the photosensitive drum 1 is transferred to the transferring belt 6. Then the color image on the transferring belt 6 is transferred to a printing medium, which is delivered from a paper cassette 7 and passes between the transferring belt 6 and a backup roller 8 rotating in contact with the transferring belt 6. The color image transferred to the printing medium is then fixed while passing through a fixing unit 9.

In the meanwhile, on each surface of the photosensitive drum 1 and the transferring belt 6, there is some used toner that is left after the toner is transferred onto the transferring belt 6 or to the printing medium in the processes as described above. In order to remove the remaining used toner, used toner cleaning units 10, 12 are disposed at each one of the photosensitive drum 1 and the transferring belt 6.

In each one of the cleaning units 10, 12, the used toner removed from the photosensitive drum 1 or the transferring belt 6 is collected in a used toner collecting container along a predetermined way.

FIG. 2 shows a drawing of Japanese patent laid-open No. H11-202710 as one example of conventional used toner collecting apparatuses for collecting used toner from the photosensitive drum after developing process.

Referring to FIG. 2, used toner that is removed from the photosensitive drum (not shown) by a predetermined cleaning means (not shown) is transported to a drop pipe 16 that is disposed at one end of a transporting pipe 14 by an auger 15 which is set up in the transporting pipe 14. The drop pipe 16 is connected to an inlet 18*a* of a collecting container 18 that admits the used toner as the used toner drops from the drop pipe 16. The collecting container 18 includes a scattering member 19 disposed inside the collecting container 18 in a predetermined pose to disperse the dropping used toner evenly in the collecting container 18. In practice, the used toner, dropping from the inlet 18*a*, collides with the scattering member 19, and is dispersed evenly in the collecting container 18.

However, in the conventional used toner collecting apparatus as described above, the used toner occasionally lumps together because the used toner is pushed and moved in one direction by the auger 15 in the transporting pipe 14. A lump of used toner is not shattered even though it crashes against the scattering member 19 and drops as a lump into the collecting container 18. In this case, the collecting container 18 cannot admit the used toner efficiently because the used toner does not scatter evenly in the collecting container 18.

Also, the collecting container 18 may be is designed in various shapes in accordance with a size or a model of a laser printer. When a collecting container has a wide bottom, there is a problem that the used toner is hard to pile up evenly on the collecting container bottom if the lumped used toner is not broken finely.

SUMMARY OF THE INVENTION

Therefore, an aspect of the present invention provides a used toner collecting apparatus having a structure capable of breaking a lump of used toner and collecting the used toner after the used toner is broken.

According to the present invention, a used toner collecting apparatus for a laser printer, which collects the used toner transported from a cleaner to remove the used toner left after being developed in a body of the laser printer, comprises a collecting container at the body and having a used toner inlet through which the used toner transported from the cleaner unit comes, and a shattering member inside the collecting container having a breaking blade to break the used toner that comes and drops through the used toner inlet.

In an embodiment of the invention, the shattering member comprises a first slant and a second slant being respectively at obtuse angles to a dropping direction of the used toner dropped from the used toner inlet.

Also, in an embodiment of the invention, the breaking blade is disposed at boundary between the first slant and second slant in parallel with the dropping direction of the used toner.

Also, in an embodiment of the invention, the breaking blade is disposed just below the used toner inlet.

Also, in an embodiment of the invention, the shattering member is attached at a wall of the collecting container formed the used toner inlet.

Also, in an embodiment of the invention, the breaking blade comprises a first blade face in parallel with the dropping direction of the used toner, and a second blade face having a predetermined slope with the dropping direction of the used toner.

In another aspect of the present invention, a used toner collecting apparatus of a laser printer, which collects the used toner transported from a first cleaner to remove the used toner left on a transferring medium that transfers an image transferred from a photosensitive medium to a printing medium and a second cleaner to remove the used toner left on the photosensitive medium, comprises a collecting container having a first used toner inlet through which the used toner, transported from the first cleaner, comes and a second used toner inlet, through which the used toner transported from the second cleaner comes, and a shattering member disposed under at least one of the used toner inlets inside the collecting container, having a breaking blade to break the used toner that drops from the corresponding used toner inlet.

In an embodiment of the invention, the collecting container comprises a first space portion admitting the used toner come from the first used toner inlet and a second space portion admitting the used toner come from the second used toner inlet, and the shattering member is disposed at bigger one of the first space portion and the second space portion.

Also, in an embodiment of the invention, the first space portion is wider right and left of a dropping direction of the used toner than the second space portion, and the shattering member is disposed just below the first used toner inlet of the first space portion.

Also, in an embodiment of the invention, the shattering member comprises a first slant being at obtuse angles to the dropping direction of the used toner for guiding the used toner dropped from the first used toner inlet to one side of the dropping direction, and a second slant being at obtuse angles to the dropping direction of the used toner for guiding the used toner dropped from the first used toner inlet to the other side of the dropping direction, and the breaking blade is disposed at a boundary between the first slant and second slant just below the first used toner inlet.

Additional aspects and/or advantages of the invention will be set forth in part in the description which follows and, in part, will be obvious from the description, or may be learned by practice of the invention.

BRIEF DESCRIPTION OF THE DRAWINGS

The above objects and other features of the present invention will become more apparent by describing in detail a preferred embodiment thereof with reference to the attached drawings, in which.

DETAILED DESCRIPTION OF THE PREFERRED EMBODIMENTS

Figure 1:
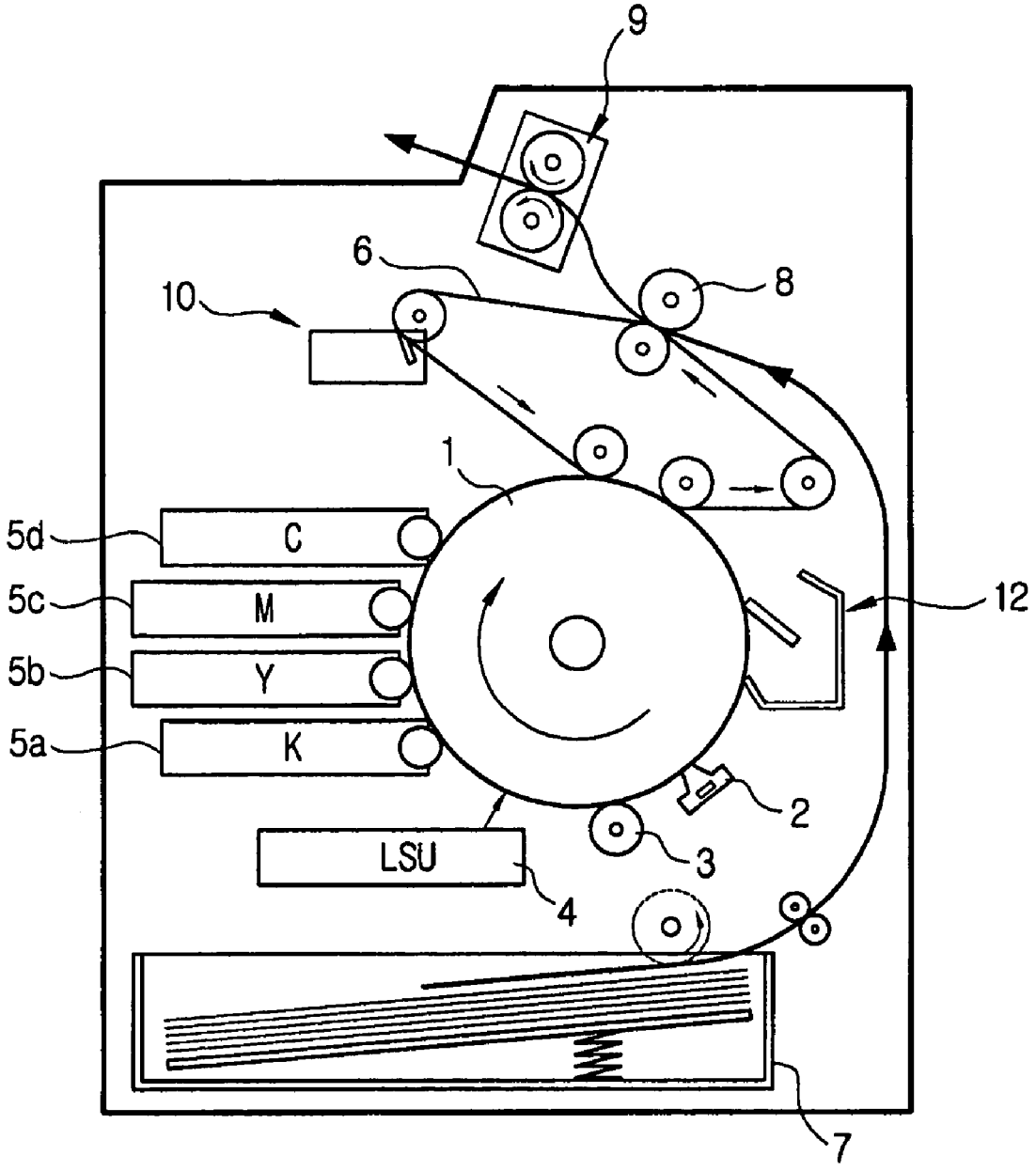
FIG. 1 (PRIOR ART)
FIG. 1 is a sectional view illustrating a structure of a conventional laser printer.
Figure 2:
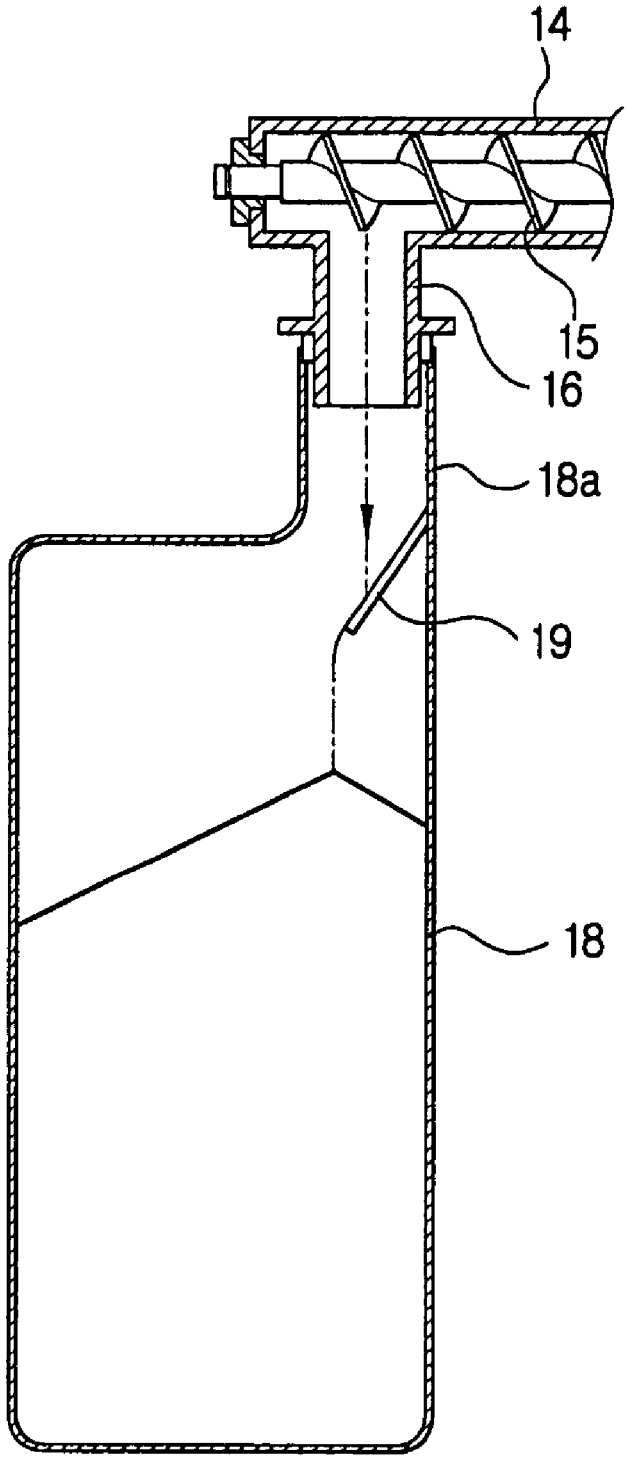
FIG. 2 (PRIOR ART)
FIG. 2 is a sectional view illustrating a conventional used toner collecting apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, an embodiment of the present invention will be described in detail with reference to the accompanying drawings.

A used toner collecting apparatus of a laser printer, according to an embodiment of the present invention, is a device to collect the used toner having been transported from a cleaner, which removes toner remaining on a photosensitive drum or on a transferring belt after image developing. Here, before explaining the used toner collecting apparatus according to an embodiment of the present invention, a structure of a laser printer having cleaners and the used toner collecting apparatus therein according to an embodiment of the present invention will be described.

Figure 3:
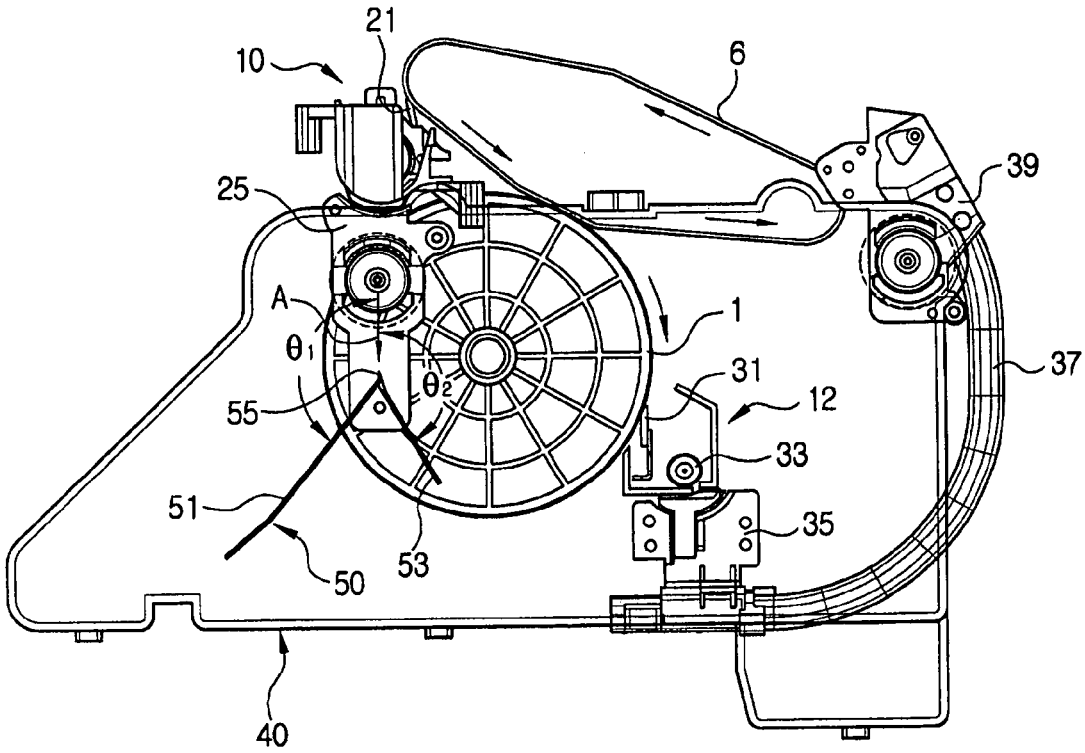
FIG. 3 is a side view illustrating a used toner collecting apparatus according to an embodiment of the present invention.

The laser printer illustrated in FIG. 3 has a similar construction as that of the conventional laser printer explained by referring to FIG. 1. Therefore, throughout the description, the like elements having the same construction and function as those of the conventional laser printer as described above with reference to FIG. 1 will be referred to by the same reference numerals. The K, Y, M, C developers (5*a*, 5*b*, 5*c*, 5*d*: see FIG. 1) are arranged in order in a direction of rotation of the photosensitive drum 1. Also, a transferring belt 6 is disposed to travel in contact with the photosensitive drum 1. An image developed on a surface of the photosensitive drum 1 by each one of the above developers is transferred to the transferring belt 6. The transferring belt 6 has a first cleaner 10 to remove the used toner from the surface of the transferring belt 6 after the image is transferred to a printing medium.

Figure 4:
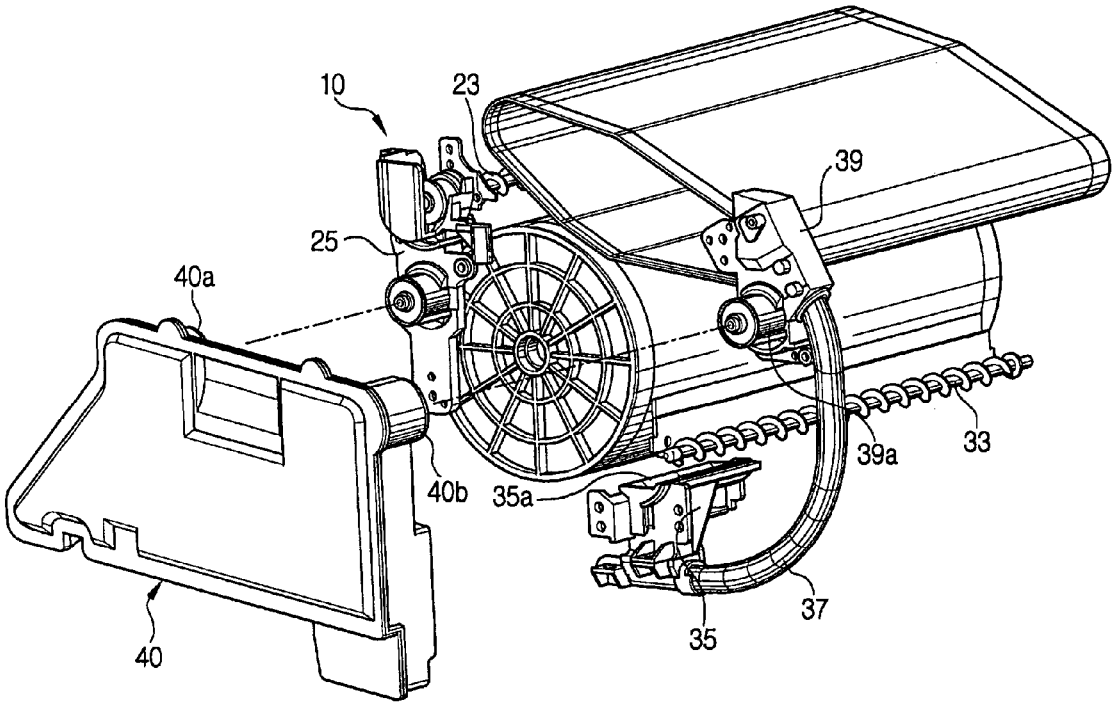
FIG. 4 is a perspective view illustrating the used toner collecting apparatus and its peripheral components of FIG. 3.
Figure 5:
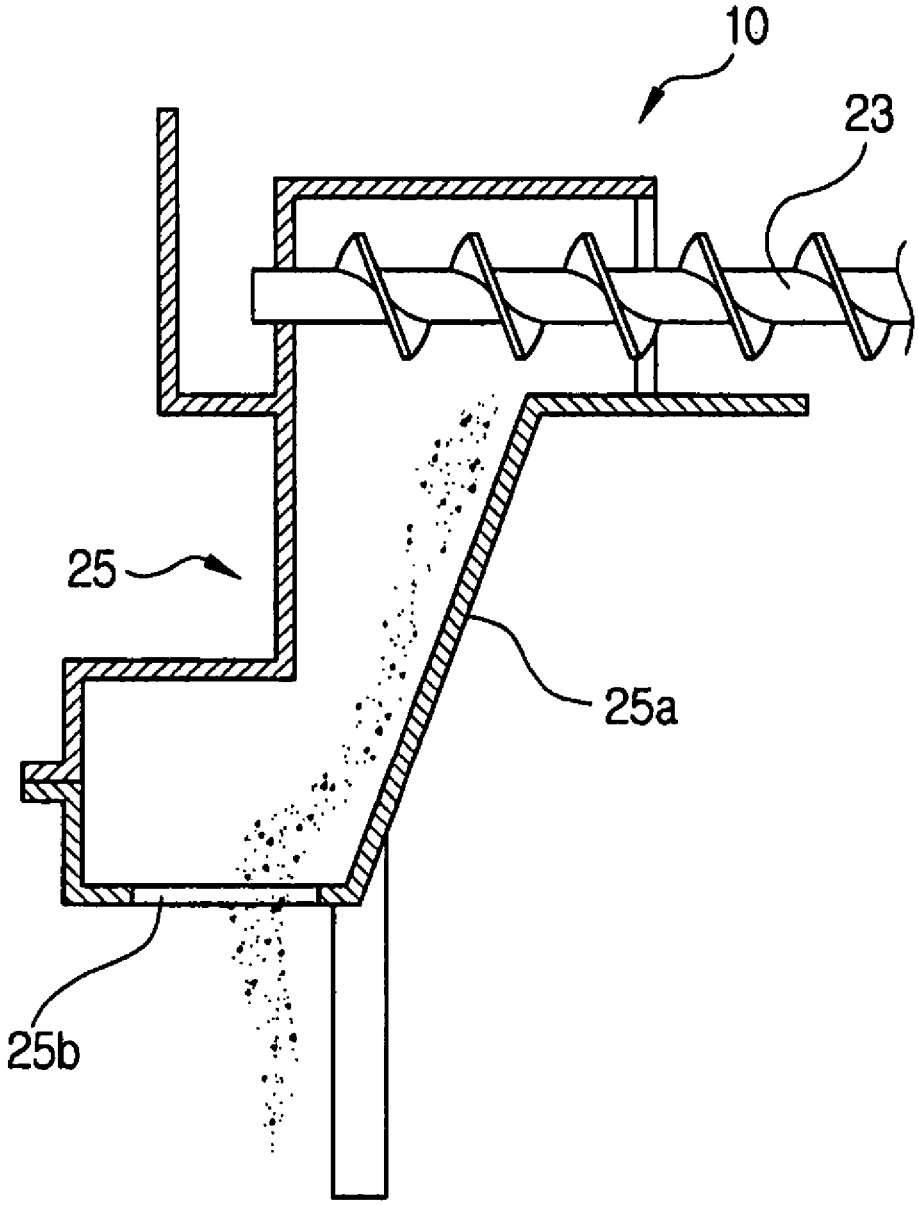
FIG. 5 is a sectional view illustrating a principal part of FIG. 4.

The first cleaner 10 comprises a cleaning blade 21 to contact the transferring belt 6, an auger 23 (see FIG. 4) to collect the used toner removed by the cleaning blade 21 in one side, and a conveying duct 25 to guide the used toner collected in one side by the auger 23 to a collecting container 40 described below. By rotating, the auger 23 pushes and transports the used toner, removed by the cleaning blade 21, toward the conveying duct 25. Referring to FIG. 5, the conveying duct 25 has an inclined plane 25*a* inside thereof. The used toner collected by the auger 23 falls down along the inclined plane 25*a*, and is discharged through an outlet 25*b* at a low portion of the conveying duct 25. The first cleaner 10 described above has a similar structure as the conventional cleaner, and therefore, further explanation is omitted.

Also, the photosensitive drum 1 has a second cleaner 12 to remove the remaining used toner from the surface of the photosensitive drum 1 after toner is transferred onto the transferring belt 6. The second cleaner 12 comprises a cleaning blade 31 to contact the photosensitive drum 1, an auger 33 to transport the removed used toner to one side, a housing 35 to collect the used toner which is transported to one side by the auger 33, a conveying pipe 37 to transport the used toner collected in the housing 35 to a predetermined position, and a used toner discharge duct 39 at the upper portion of the conveying pipe 37. The used toner discharge duct 39 is disposed above the housing 35 in predetermined height, and is capable of dropping the used toner through the used toner inlet 40*b* formed at the upper portion of the collecting container 40. Accordingly, the collecting container 40 collects the used toner in as much quantity as possible, while preventing the used toner inlet 40*b* from clogging. The housing 35 has a toner drop 35*a* in its upper portion, and the used toner transported by the auger 33 drops into the housing 35 through the toner drop 35*a*. Inside the conveying pipe 37, there is a pump to drive the used toner up to the discharge duct 39. As an example, a flexible auger may serve as the pump. The discharge duct 39 is similar to the structure of the conveying duct 25. Thus, the discharge duct 39 has an inclined plane (not shown) in its inside, and allows the used toner, pumped from the housing 35, fall down through a discharge hole 39*a*.

In the structure described above, a used toner collecting apparatus according to an embodiment of the present invention comprises a collecting container 40 collecting the used toner removed and transported by each one of the cleaning units 10, 12 and a shattering member 50 disposed at inside of the collecting container 40.

Figure 6:
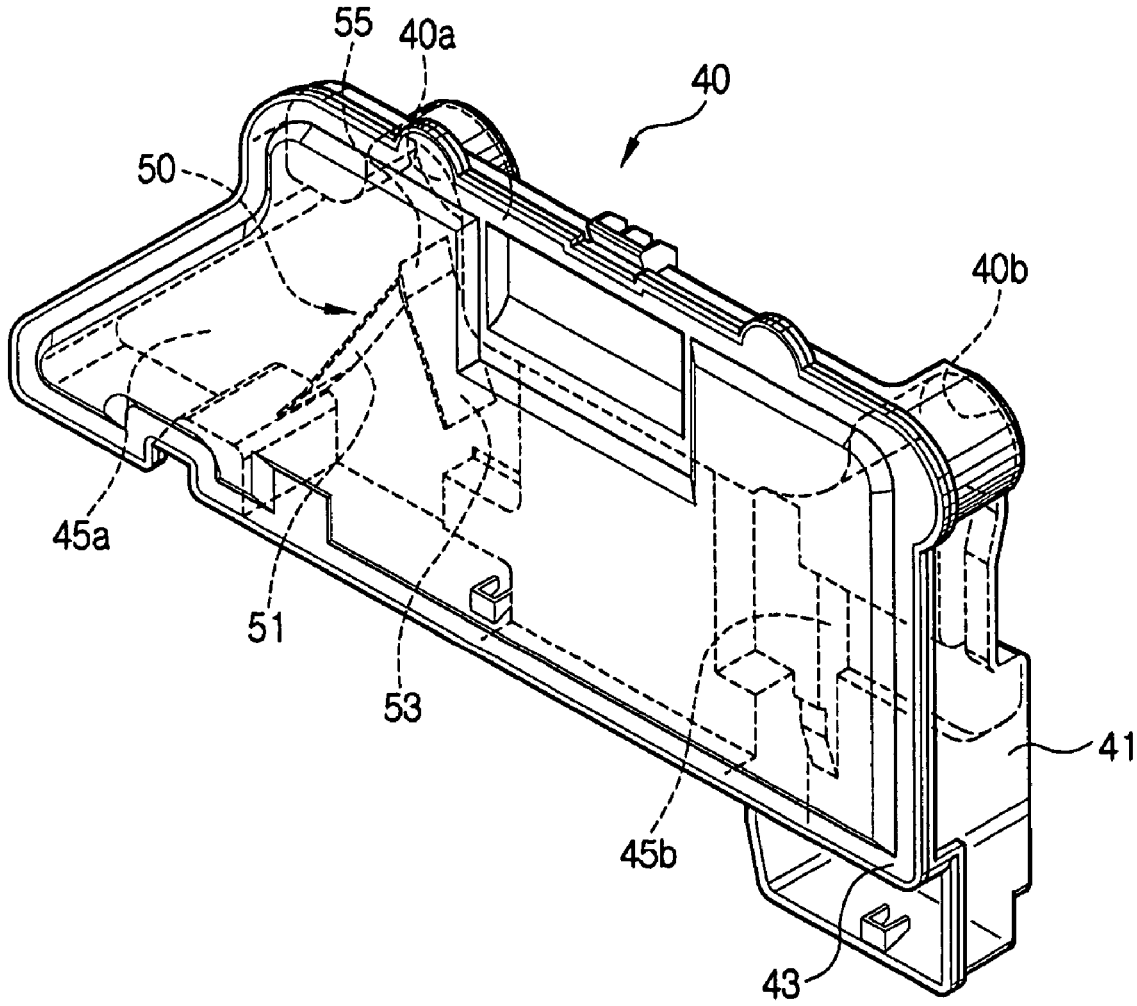
FIG. 6 is a perspective view illustrating the used toner collecting apparatus of FIG. 3.

Referring to FIG. 6, the collecting container 40 is vertically disposed in front of the photosensitive drum 1, and has a first used toner inlet 40*a* and a second used toner inlet 40*b*. The first and second used toner inlets 40*a*, 40*b* are formed in the same height in upper portions of the collecting container 40. The first used toner inlet 40*a* is formed to collect the used toner, which is removed by the first cleaner 10 and the second used toner inlet 40*b* is formed to collect the used toner removed by the second cleaner 12.

The collecting container 40 comprises a rear wall 41 in which the first and second used toner inlets 40*a*, 40*b* are formed, and a front wall 43 formed in front of the rear wall 41. A first space portion 45*a* and a second space portion 45*b* are formed between the rear wall 41 and the front wall 43. The used toner enters through each one of the first and second used toner inlets 40*a*, 40*b* and is admitted in each one of the first and second space portions 45*a*, 45*b*. In detail, the first space portion 45*a* has a width which is greater than a height of the first space portion 45*a*, and the second space portion 45*b* has a height, which is greater than a width of the second space portion 45*b*. The used toner coming in through the first used toner inlet 40*a* is admitted in the first space portion 45*a* and the used toner coming in through the second used toner inlet 40*b* is admitted in the second space portion 45*b*. The first and second space portions 45*a*, 45*b* fluidly communicate with each other.

Figure 7:
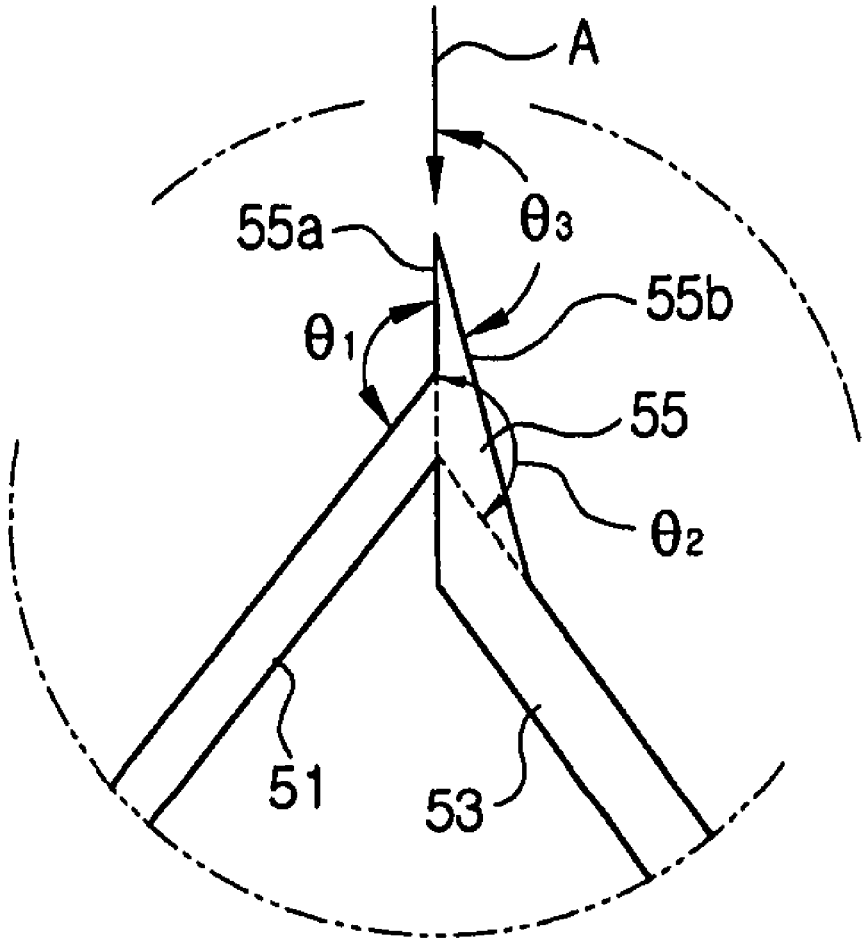
FIG. 7 is an enlarged view illustrating a principal part of a shattering member of FIG. 6.

Referring to FIG. 6 and FIG. 7, the shattering member 50 is disposed inside the collecting container 40. The shattering member 50 shatters the used toner which drops into the collecting container 40 through the first used toner inlet 40*a*, and spreads the shattered used toner evenly throughout the first and second space portions 45*a*, 45*b*. Because the first space portion 45*a* has a wider space in a horizontal direction, the shattering member 50 allows the used toner to spread evenly from side to side. To achieve this, the shattering member 50 has a first slant 51 and a second slant 53, which are placed at obtuse angles $\theta_1$, $\theta_2$ to a dropping direction A of the used toner, and a breaking blade 55 which is disposed at a border between the first slant 51 and the second slant 53.

The first slant 51 is longer than the second slant 53 according to a structure of the first space portion 45*a*. The lower portions of the first and second slants 51, 53 are at a predetermined distance from a bottom of the first space portion 45*a*.

The breaking blade 55 is disposed just below the first used toner inlet 40*a*, and breaks lumps of the used toner falling to the dropping direction A. As shown in FIG. 7, the breaking blade 55 has a first blade face 55*a* that is parallel to the dropping direction A and a second blade face 55*b* that is placed at obtuse angle $\theta_3$ to the dropping direction A.

Figure 8:
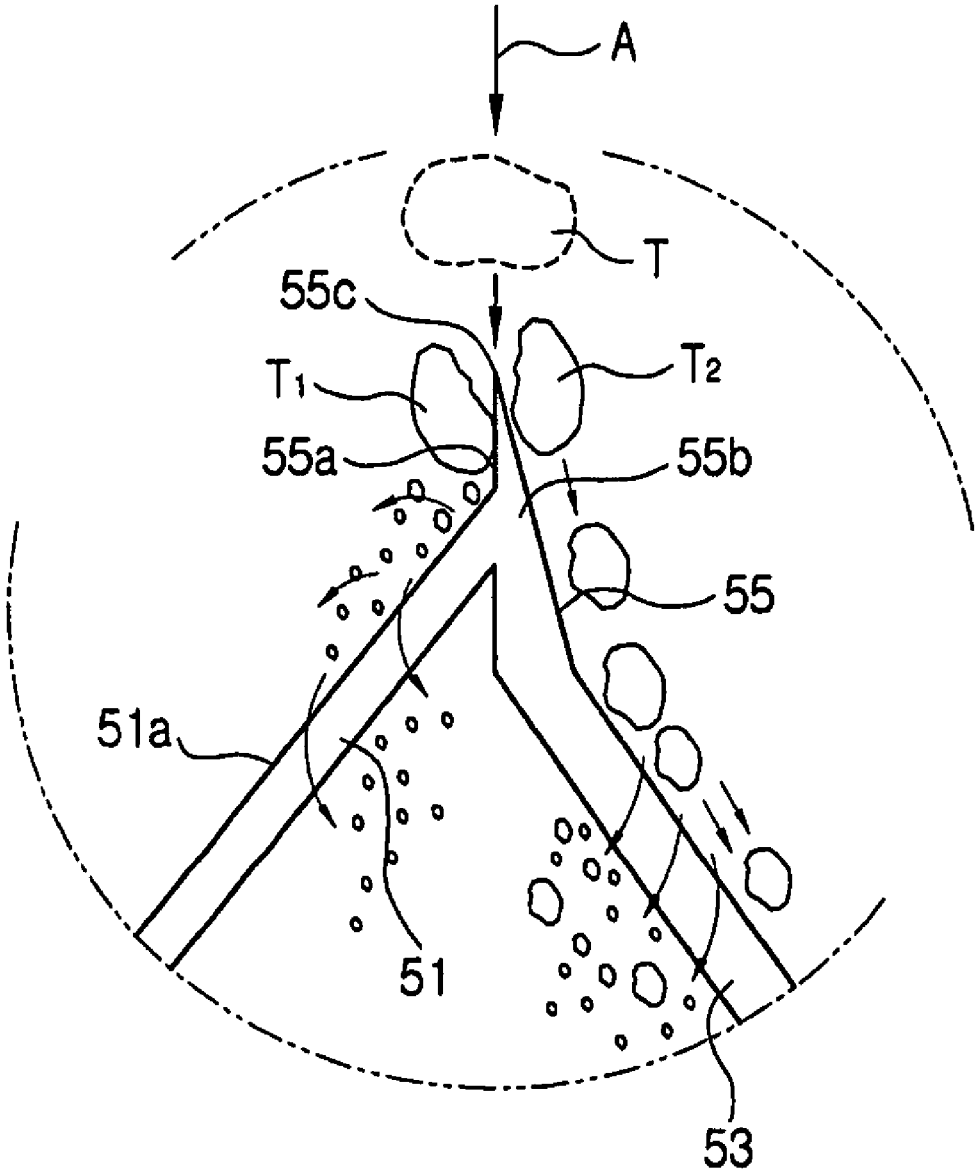
FIG. 8 and FIG. 9 are sectional views for explaining an operation of the used toner collecting apparatus according to FIGS. 3 and 6.

Accordingly, as shown in FIG. 8, a lump of used toner T that drops in a dropping direction A contacts a point of the breaking blade 55*c* and is broken into pieces, T1 and T2. Next, the lump of used toner, T1 which was a part of toner T, rolls toward the first blade face 55*a* among other lumps of used toner, also broken by the breaking blade 55, and contacts a slanted face 51*a* of the first slant 51. Some small lumps of used toner, broken by the first blade face 55*a*, bounce and splatter into the first space portion 45*a*, and others roll along the slant face 51*a* and pile up into a left side of the first space portion 45*a*.

Meanwhile, the lump of used toner T2 rolls toward the second blade face 55*b*, counterbalances with the slope of the second blade face 55*b*, and rolls down, or slides down along a slant face 53*a* of the second slant 53. Therefore, the left lump of used toner T1 is broken more finely and spreads more evenly than the right lump T2. The right lump of used toner T2 is broken in a relatively bigger lump, and is piled up in the right side of the first space portion 45*a*. As described above, breaking and spreading ranges of used toner can be controlled by adjusting the angles of the both blade faces 55*a*, 55*b* of the breaking blade 55. When the first space portion 45*a* has a bigger space in a left side of the first used toner inlet 40*a* than in a right side, used toner can be broken more finely and spread more evenly in the left side of the first space portion by controlling the angles of the both blade faces 55*a*, 55*b* of the breaking blade 55.

In an embodiment of the invention, the breaking blade 55 having a function as described above is formed as one body with the first slant 51 and second slant 53, and also with the rear wall 41.

Figure 9:
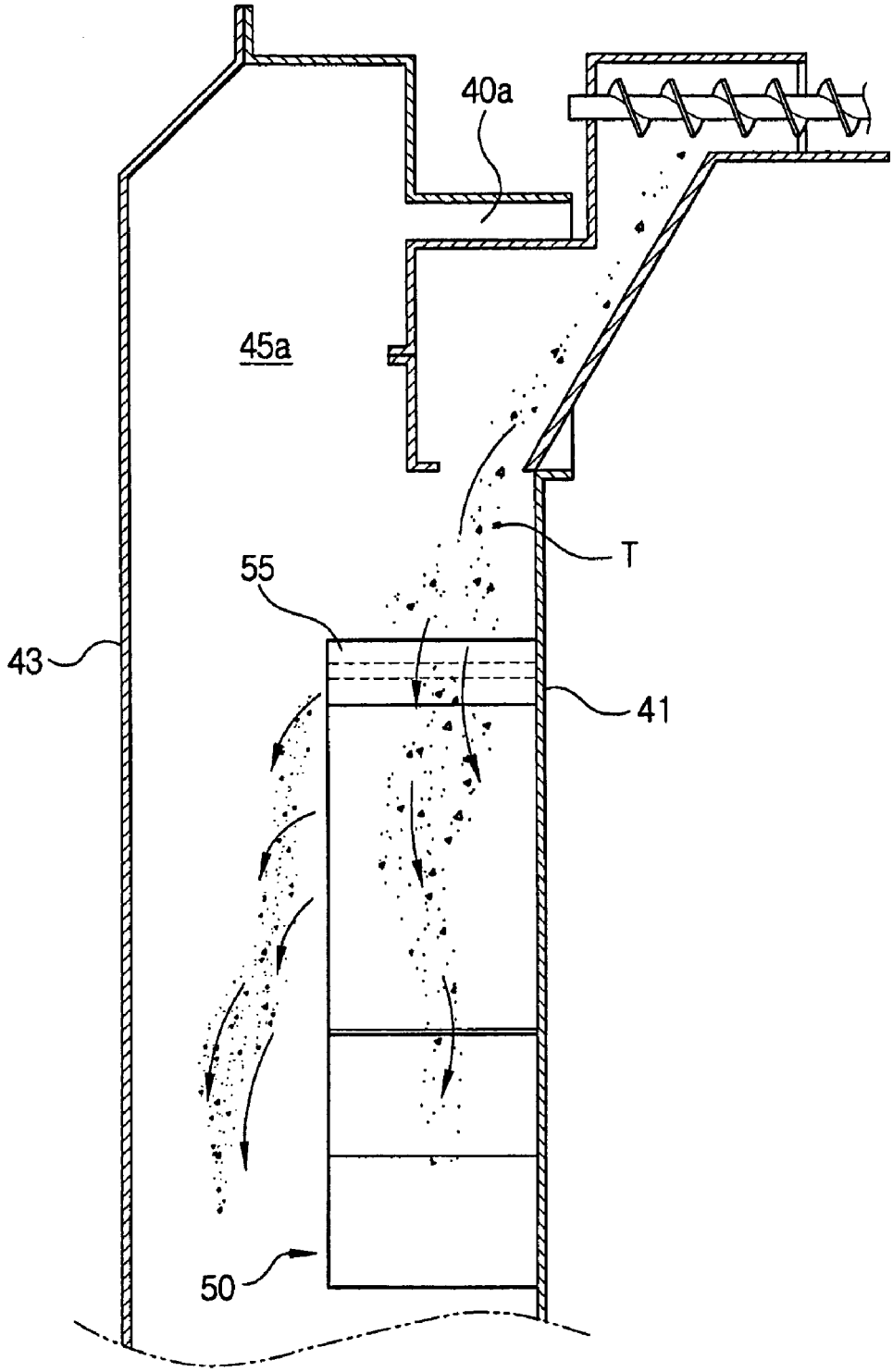

Also, as shown in FIG. 9, a width of the shattering member 50 having the breaking blade 55 is narrower than a gap between the rear wall 41 and the front wall 43. Therefore, the used toner is piled up evenly just below the shattering member 50, because the used toner broken by the shattering member 50 drops down between the shattering member 50 and the front wall 43.

According to the present invention as described above, the used toner collecting apparatus of the laser printer enables the lump of used toner that is removed by the cleaning unit and collected to the collecting container to effectively break and to spread evenly in the collecting container.

As a result, a term of use of the collecting container can be lengthened because the collecting apparatus according to the present invention uses the space of the collecting container at full stretch for collecting used toner.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A used toner collecting apparatus of a laser printer, which collects the used toner, which is transported from a cleaner that removes the used toner remaining after image developing in a body of the laser printer, comprising:

a collecting container at the body, having a used toner inlet through which the used toner, transported from the cleaner, enters; and a shattering member, inside the collecting container, having a breaking blade to break the used toner that drops through the used toner inlet, wherein the shattering member comprises a first slant and a second slant, each respectively at different obtuse angles to a dropping direction of the used toner dropped from the used toner inlet, wherein the breaking blade comprises a first blade face and a second blade face.

2. The used toner collecting apparatus of claim 1, wherein the breaking blade borders the first slant and second slant in parallel with a dropping direction of the used toner.

3. The used toner collecting apparatus of claim 1, wherein the breaking blade is disposed below the used toner inlet.

4. The used toner collecting apparatus of claim 1, wherein the shattering member is attached at a wall of the collecting container.

5. A used toner collecting apparatus of a laser printer, which collects the used toner, which is transported from a cleaner that removes the used toner remaining after image developing in a body of the laser printer, comprising:

a collecting container at the body, having a used toner inlet through which the used toner, transported from the cleaner, enters; and a shattering member, inside the collecting container, having a first slant, a second slant, and a breaking blade to break the used toner that drops through the used toner inlet, wherein the breaking blade comprises:

a first blade face in parallel with a dropping direction of the used toner from the used toner inlet; and a second blade face having a predetermined slope with respect to the dropping direction of the used toner, the first and second blade faces forming an acute angle with respect to each other.

6. A used toner collecting apparatus of a laser printer, which collects the used toner, which is transported from a first cleaner to remove the used toner left on a transfer medium, and a second cleaner to remove the used toner left on a photosensitive medium, the used toner collecting apparatus comprising:

a collecting container, having a first used toner inlet through which the used toner, transported from the first cleaner, enters, and a second used toner inlet through which the used toner transported from the second cleaner, enters; and a shattering member under at least one of the used toner inlets inside the collecting container, having a first slant, a second slant, and a breaking blade to break the used toner that drops from the corresponding used toner inlet, wherein the breaking blade comprises:

a first blade face in parallel with a dropping direction of the used toner from the first and second used toner inlets, and a second blade face having a predetermined slope with respect to the dropping direction of the used toner, the first blade face and the second blade face forming an acute angle with respect to each other.

7. The used toner collecting apparatus of claim 6, wherein the collecting container comprises:

a first space portion having a first volume to admit the used toner from the first used toner inlet; and a second space portion having a second volume to admit the used toner from the second used toner inlet, wherein the shattering member is disposed at one of the first and second space portions, having a larger volume.

8. The used toner collecting apparatus of claim 7, wherein the first space portion is wider than the second space portion in a horizontal direction, and the shattering member is disposed below the first used toner inlet of the first space portion.

9. The used toner collecting apparatus of claim 8, wherein the shattering member further comprises a first slant at a first obtuse angle to the dropping direction of the used toner to guide the used toner, dropped from the first used toner inlet, to one side of the shattering member; and a second slant at a second obtuse angle to the dropping direction of the used toner to guide the used toner, dropped from the first used toner inlet to the other side of the dropping direction, wherein the breaking blade is disposed at a border between the first slant and second slant just below the first used toner inlet.

10. A collecting apparatus of an image forming device, having a photosensitive drum to act as a photosensitive medium and a transferring belt in contact with the photosensitive drum, both of which having used toner stuck thereto, comprising:

a collecting container, having a first used toner inlet through which unstuck used toner drops before entering the collecting container; and a shattering member, inside the collecting container, having a first slant, a second slant, and a breaking blade to break down the used toner, which drops through the first used toner inlet, wherein the breaking blade comprises:

a first blade face in parallel with a dropping direction of the used toner from the first used toner inlet, and a second blade face having a predetermined slope with respect to the dropping direction of the used toner from the first used toner inlet, the first blade face and the second blade face forming an acute angle with respect to each other.

11. A collecting apparatus of an image forming device to collect used toner, including a photosensitive drum and a transferring belt in contact with the photosensitive drum, both of which having used toner stuck thereto, comprising:

a collecting container, having at least one of first and second used toner inlets through which unstuck used toner enters the collecting container; and a shattering member, inside the collecting container, having a breaking blade to break the used toner that enters the collecting container, wherein the shattering member comprises:

a first slant, and a second slant, different from the first slant, wherein the first and second slants respectively form obtuse angles to a dropping direction of the used toner entering the collecting container dropping from the first and second used toner inlets, wherein the breaking blade comprises a first blade face and a second blade face.

12. The collecting apparatus according to claim 11, wherein the breaking blade borders the first and second slants.

13. The collecting apparatus according to claim 12, further comprising:

a top end of the breaking blade; and a lower end of the used toner inlet, wherein the top end of the breaking blade extends to just below the lower end of the first used toner inlet.

14. The collecting apparatus according to claim 11, wherein the shattering member is attached to a wall of the collecting container.

15. The collecting apparatus according to claim 11, wherein the breaking blade comprises:

a first blade face in parallel with the dropping direction of the used toner; and a second blade face having a predetermined slope with respect to the dropping direction of the used toner.

16. The collecting apparatus according to claim 11, further comprising a first cleaner to remove the used toner from the transferring belt.

17. The collecting apparatus according to claim 16, wherein the first cleaner comprises:

a cleaning blade to contact the transferring belt and to remove the used toner therefrom;

an auger to collect the used toner removed by the cleaning blade; and a conveying duct to guide the used toner collected by the auger to the collecting container.

18. The collecting apparatus according to claim 17, wherein the conveying duct comprises:

an inclined plane along which the used toner travels; and an outlet at a low portion of the conveying duct and below the inclined plane.

19. The collecting apparatus according to claim 11, further comprising a second cleaner to remove the used toner from the photosensitive drum.

20. The collecting apparatus according to claim 19, wherein the second cleaner comprises:

a cleaning blade to contact the photosensitive drum and to remove the used toner therefrom;

an auger to transport the used toner removed by the cleaning blade to a side of the cleaner;

a housing to collect the used toner which is transported by the auger; and a conveying pipe to guide the used toner collected by the auger to the collecting container.

21. The collecting apparatus according to claim 11, wherein the collecting container further comprises:

a rear wall in which the first and second used toner inlets are formed;

a front wall formed in front of the rear wall; and first and second space portions, between the rear and front walls, into which used toner is admitted after passing through the first and second used toner inlets, respectively.

22. The collecting apparatus according to claim 21, wherein the first and second space portions respectively have widths and heights, the width of the first space portion being greater than the height of the first space portion, and the height of the second space portion being greater than a width of the second space portion.

23. The collecting apparatus according to claim 11, wherein the shattering member allows the used toner to spread evenly from a side to a side of the shattering member.

24. A collecting apparatus of an image forming device to collect used toner, including a photosensitive drum and a transferring belt in contact with the photosensitive drum, both of which having used toner stuck thereto, comprising:

a collecting container, having at least one of first and second used toner inlets through which unstuck used toner enters the collecting container;

a shattering member, inside the collecting container, having a breaking blade to break the used toner that enters the collecting container; and a second cleaner to remove the used toner from the photosensitive drum, wherein the second cleaner comprises:

a cleaning blade to contact the photosensitive drum and to remove the used toner therefrom, an auger to transport the used toner removed by the cleaning blade to a side of the cleaner, a housing to collect the used toner which is transported by the auger, and a conveying pipe to guide the used toner collected by the auger to the collecting container, and wherein the conveying pipe comprises:

an upper portion, and a used toner discharge duct at the upper portion of the conveying pipe.

25. The collecting apparatus according to claim 24, wherein the used toner discharge duct drops used toner into the second used toner inlet.

26. The collecting apparatus according to claim 20, wherein the housing comprises a toner drop through which used toner, transported by the auger, drops into the housing.

27. The collecting apparatus according to claim 20, wherein the conveying pipe comprises a pump to drive the used toner.

28. The collecting apparatus according to claim 27, wherein the pump is a flexible auger.

29. A collecting apparatus of an image forming device to collect used toner, comprising:

a collecting container, having at least one of first and second used toner inlets through which the used toner drops and enters the collecting container; and a shattering member, inside the collecting container, having a breaking blade to break the used toner that enters the collecting container, wherein the broken used toner spreads evenly across the collecting container, wherein the shattering member comprises:

a first slant, and a second slant, different from the first slant, wherein the first and second slants respectively form obtuse angles to a dropping direction of the used toner dropping from the first and second used toner inlets wherein the breaking blade comprises a first blade face and a second blade face.

* * * * *

UNITED STATES PATENT AND TRADEMARK OFFICE

CERTIFICATE OF CORRECTION

PATENT NO. : 7,239,841 B2
APPLICATION NO. : 10/830084
DATED : July 3, 2007
INVENTOR(S) : Heung-eup Jeong et al.

It is certified that error appears in the above-identified patent and that said Letters Patent is hereby corrected as shown below:

Column 6, line 59, Claim 1, change “slant,” to --slant--.

Column 8, Line 40, Claim 11, change “inlets,” to --inlets--.

Signed and Sealed this

Fourth Day of December, 2007

JON W. DUDAS
*Director of the United States Patent and Trademark Office*